US007954992B2

(12) United States Patent
Tytar

(10) Patent No.: US 7,954,992 B2
(45) Date of Patent: Jun. 7, 2011

(54) MULTI-USE PORTABLE MIXING DEVICE

(76) Inventor: Frank A. Tytar, New Hudson, MI (US)

( * ) Notice: Subject to any disclaimer, the term of this patent is extended or adjusted under 35 U.S.C. 154(b) by 942 days.

(21) Appl. No.: 11/821,655

(22) Filed: Jun. 25, 2007

(65) Prior Publication Data

US 2007/0297277 A1 Dec. 27, 2007

Related U.S. Application Data

(60) Provisional application No. 60/815,927, filed on Jun. 24, 2006.

(51) Int. Cl.
*B01F 7/22* (2006.01)

(52) U.S. Cl. ..... 366/129; 366/263; 366/265

(58) Field of Classification Search ..... 366/129, 366/262–265, 270
See application file for complete search history.

(56) References Cited

U.S. PATENT DOCUMENTS

| | | | | | |
|---|---|---|---|---|---|
| 87,147 | A * | 2/1869 | Cooley | 366/265 |
| 141,709 | A * | 8/1873 | Fuqua | 416/181 |
| 378,381 | A * | 2/1888 | Towar | 366/263 |
| 619,811 | A * | 2/1899 | Vernon | 366/262 |
| 630,768 | A * | 8/1899 | Benjamin | 366/265 |
| 2,108,162 | A * | 2/1938 | Clark | 366/228 |
| 2,419,814 | A * | 4/1947 | Boileau | 366/228 |
| 6,736,538 | B2 * | 5/2004 | Bittner | 366/199 |

* cited by examiner

*Primary Examiner* — David L Sorkin

(57) ABSTRACT

A device and method of transporting and blending substances into a container of fluid.

3 Claims, 14 Drawing Sheets

MULTI-USE PORTABLE MIXING DEVICE

CROSS-REFERENCE TO RELATED APPLICATION

Figure 1:
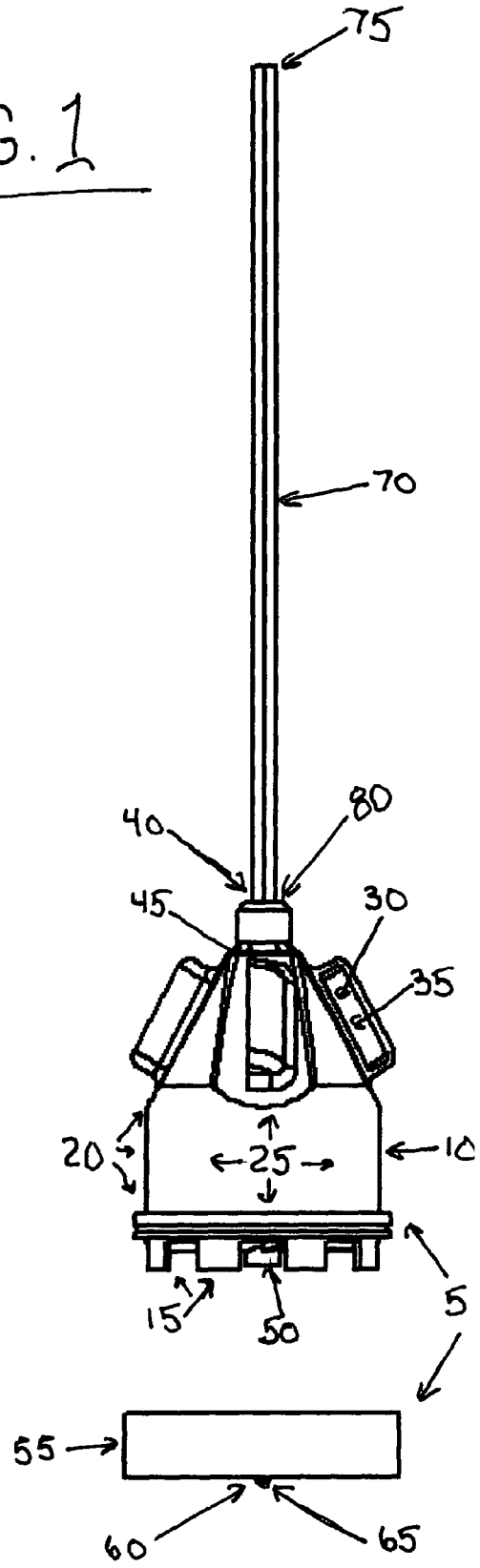

This application claims the priority of U.S. provisional patent application No. 60/815,927 filed on Jun. 24, 2006.

STATEMENTS REGARDING FEDERALLY SPONSORED RESEARCH OR DEVELOPMENT

N/A

BACKGROUND OF THE INVENTION

1. Field of the Invention

This invention relates to equipment and tools used by painters, tradesmen, homeowners, and various other individuals. More specifically, this invention relates to a device for mixing substances and fluid, and a method for transporting and blending solid, powdery and/or liquid substances, such as coloring substances, into fluid.

2. Description of the Related Art

Any discussion of the prior art throughout the specification should in no way be considered as an admission that such prior art is widely known or forms part of common general knowledge in the field.

A severe problem in the world today is the introduction of hazardous chemicals into the environment especially disposed chemicals. In the case of painting, the user estimates quantity and buys material in excess of the estimated quantity to complete the job. This to insure sufficient quantity so as not to run short, an extremely detrimental part of painting because of work stoppages and the risk of receiving non matching paint from a different batch. From the users estimate of material for wall and trim primer and wall and trim top coat(s) on the overall job, the waste is normally 1-3 gallons or more on smaller jobs with few colors, 5 to 15 gallons or more on larger new construction jobs, a substantial quantity of extra paint. The store can accept returns of unused, unmixed paint, since the paint store commonly handles and supplies the coloring substances; the paint is premixed at the time of purchase. The purchaser cannot return the unused premixed paint with the excess being improperly disposed onto job sites or landfills. The device and method of the present invention utilizes a portable mixing device that holds coloring substances to be mixed into a container. The user only mixes what is needed, allowing the remaining unmixed paint to be returned for refund. This method would greatly reduce or eliminate the introduction of hazardous chemicals into the eco system, and reduce consumer costs.

The mixing and blending of viscous fluids has historically been an arduous task. Present methods of mixing and blending such fluids often result in inadequate mixing and blending and are time and energy consumptive. Probably the most common method of mixing fluid or delicately mixing specialty fluids involves the user opening the container, inserting a stick or rod and stirring the liquids within the container. This method is tiring, requiring tremendous effort to move the stir stick through the viscous fluid. The effort is rendered useless in heavy bodied solidified fluids such as gels. Due to the effort required, individuals often concede, stopping long before the fluid is adequately mixed. Furthermore, if the individual continues stirring for a long period of time, there is no guarantee that the fluid will be thoroughly mixed. Using the device of the present invention, the user simply positions the device into a container of fluid, connecting the free end of a shaft of the device to the rotary drive means, such as a drill, and rotating the mixing device within the fluid. The objective of the present invention is to offer a more versatile means of mixing a variety of fluids efficiently without the tremendous effort associated with hand blending. The result is a consistent, uniform effect and a faster energy saving method. This is important to reduce the total time necessary for a particular session to thoroughly mix the fluid for a well-blended uniform product. To address specialty fluids, the present invention's prop is detachable to accommodate delicate mixing preventing shearing, slamming or break down of suspended solids such as metallic flecks or chips. Propeller detachment will prevent the destabilization of delicate fluids and adverse changes to the material properties. The prop is intended to accommodate heavier bodied fluids helping to propel fluid through the device and circulate fluid in the container achieving the desired consistency. The device of the present invention provides a well-blended product, producing uniformity in a wide range of fluids with speed and precision.

Several devices have been developed for mixing paint which feature drive shafts for connection to drills. For example, U.S. Pat. No. 4,893,941 to Wayte discloses a mixing device that comprises a circular disc having vanes connected thereto. The apparatus is rotated by connecting a drill to a shaft which is connected to the device. This device suffers from at least two shortcomings. First, the limited number of vanes does not provide for thorough mixing. Second, because the bottom disc is contiguous, no fluid is drawn through the device from the bottom. In most instances it is often critical that fluid from the bottom of the container be drawn upward when mixing viscous fluids, since this is where the heaviest of the fluids separate prior to mixing. The present invention addresses these problems by providing a device that draws fluid from the bottom with the option of drawing fluid from the top in different combinations to give more versatility in a greater range of fluids thus, producing a thorough mixing and a consistent uniform product, so critical to effective color matching.

Another method of mixing paint comprises shaking the paint in a closed container. This can be done by hand or by expensive motor-driven shaker. In either instance, the mixing is time consuming and often in complete. Because the shaking occurs with the container closed, little air space is available within the container for the fluid to move about. Therefore, the shaking often tends to move the fluid very little within the container with the result being ineffective mixing. The greatest drawback with motor-driven shakers is producing consistent uniformity, since the substances within the container seldom blend properly. If the paint store's employee does not leave the container on the motor-driven shaker long enough (as often happens due to time restraints of customer service), the incomplete mixing results in a poor color match. As the user empties a shaken container and scrapes it clean there will be undisbursed pigment and untinted paint on the sides and bottom of the container. The objective of the device of the present invention is to broadcast the substances and fluid evenly as it circulates through the device and container to obtain a more consistent and uniform paint color, eliminating paint shade variations that occur from using a motor-driven shaker.

Commonly, the delivery of paint coloring substance is normally handled by a paint store, not by the consumer. The paint stores are inefficient when it comes to this method. It is not uncommon to have a long wait. Currently when the consumer wants to purchase paint, the consumer places their order with a store employee. The employee goes back into a storage area, retrieves the desired order; lifts and moves the order to a tint machine that holds coloring substances, types in the desired color, opens each gallon or five gallon container and individually injects coloring substances into the container(s). Then, the employee then re-lids and re-lifts the containers and carries them to a motor-driven shaker, if one is not available there is a wait. If the motor-driven shaker is not being used, the employee individually places the container(s) into the available motor-driven shaker, the employee then turns on the motor-driven shaker for 3-7 minutes. The store only has a limited amount of motor-driven shakers because they take up a lot of store space and are very expensive. After the time on the motor-driven shaker has expired, the employee re-lifts the container. For larger orders the employee incorporates a dolly, for smaller orders the employee carries the container(s) to the counter or to the purchaser's vehicle. It is extremely inefficient to keep lifting and re-lifting containers, waiting for an available motor-driven shaker and the time to shake the containers, especially when the person ahead orders 60 gallons. To address these problems the device and the method of the present invention greatly eliminates the over lifting, the wait and the process of an inadequate motor-driven shaker. Basically, the consumer can now place an order, the employee simply injects the coloring substances into the device of the present invention and securely closes the fit cap, goes into the storage area filling the order and brings the order out to the counter to be loaded into the customers vehicle. The store can service more than twice the volume of customers in less than half the time. The advantage to this new method is not only to reduce time of service in the store, but also to allow the consumer to return any unused paint, greatly reducing the disposal of paints into environment. The present invention will service more customers with a lot less lifting and in the case of five-gallon containers that would be highly appreciated. The device and the method of the present invention greatly improve the procedures associated with prior art. The user receives a high quality product, greatly benefiting contractors who make their living from timesavings and product quality. It is an objective of the present invention to better utilize customer wait time and offer another means of delivering coloring substances into a container. This device and method of the present invention improves store efficiency and product uniformity, saving the environment from the disposal of over purchased paints, hazardous chemicals and improves the contractor cost containment.

Many mechanisms have been proposed for mixing these fluids and reducing the manual labor associated with the same. These mechanisms have all suffered from at least one of several shortcomings: users have difficulty in using the device because of its complexity or size, the device inadequately mixes the fluid, and/or users have a difficult time cleaning up the device after using it. Other problems associated with these mixers are the limited method of use and singular options of mixing and blending. None of these mechanisms offer the convenience of being able to transport and deliver substances with the diversity to accommodate a great range of fluids. The device of the present invention is easy to use and clean, the user needing only to submerge and rotate it in a container of cleaning solution or simply detach the prop, rinse clean and let air dry.

From the foregoing, to greatly improve store efficiency, mixing and blending, better product uniformity and a cleaner eco-system, it would be highly desirable to provide a device and method to overcome the problems, difficulties, and limitations associated with prior art.

The above descriptions and examples should not be construed as limitations on the scope of the present invention. Many other variations are possible. Accordingly, the scope of the present invention is determined by the claims and their legal equivalents.

The foregoing, together with other objects, features, and advantages, will be apparent after referring to the following summary, specifications, and the accompanying drawings.

A BRIEF SUMMARY OF THE INVENTION

A device is disclosed for mixing fluid and substances, with a corresponding method.

A device for holding substances to blend and deliver into a container of fluid comprising of a body with an opening; extending sidewalls that shape a cavity; passageways with doors; connector(s); a fit cap; a shaft, a prop.

The present invention is preferably molded plastic by the mold process. The preferred materials of construction are high-density polyethylene and polypropylene. The shaft and prop is preferably corrosion resistant stainless steel.

Efficiently utilized, the present invention eliminates many of the heretofore objectionable problems associated with prior art and substantially departs from the conventional designs and methods of prior art.

It is a particular objective of the present invention to provide an exemplary mixing device for mixing fluids which can be manufactured inexpensively and operated with relatively little effort and also a blending method that can be accomplished in a simple manner. Further, to provide a device that is portable, reusable, convenient to transport, clean and store.

Another particular objective of the device and method of the present invention is to provide an optimal means of transporting substances, delivering and blending substances into a container of fluid that would efficiently reduce the wait at the store and greatly reduce the disposed fluids, such as paint, into the ecosystem.

Still yet another objective of the device and method of the present invention is to greatly reduce the employee consistent lifting and re-lifting of containers.

Still another particular objective of the present invention is to provide a means and method other than a tint machine and motor-driven shaker for blending coloring substances into a container, that would produce and obtain a more uniform and consistent paint color and minimize any paint shade variations that would occur from using a motor-driven shaker.

Advantageously, the prop is attachable and detachable so as to further functionality of the device of the present invention and to provide the consumer with more options of thoroughly mixing and blending fluid such as delicate suspension fluids and/or heavier bodied solidified fluids thus, providing an adaptation to a great range of fluids as well as easiness and convenience for cleaning up without taking much time.

Another objective of the device of the present invention is to have a combinational engagement with a rotary drive means such as to provide a variation in flow. The device can be used invert and the flow inverse or reversed to meet the needs or to accommodate a great range of fluids providing the consumer with other options of a desired flow and/or a preferred use.

It is a further objective of the device of the present invention to have a number of connectors to use the device combinational and/or to attach onto a shaft, extensions and attachments furthering the optional capability of the device.

One other objective of the present invention is to provide a reusable means of closure which is difficult for children to remove, yet is user-friendly to senior citizens, and which is designed to securely seal the present invention so as to prevent loss of its contents. This in turn, makes storing or transporting any contents more convenient and safe.

The above and other features of the present invention, including various novel details of construction and combinations of parts, will now be more particularly described with reference to the accompanying drawings and pointed out in the claims. It will be understood that the present invention is shown by way of illustration only and not as a limitation of the present invention. The principles and features of the present invention may be employed in various and numerous materials and embodiments without departing from the scope of the invention.

In this respect, before explaining at least one embodiment of the present invention in detail, it is to be understood that the present invention is not limited in its application to the details of construction and to the arrangements of the components set forth in the following description or illustrated in the drawings. The present invention is capable of other embodiments and of being practiced and carried out in various ways. Also, it is to be understood that the phraseology and terminology employed herein are for the purpose of description and should not be regarded as limiting. There are additional features of the invention that will be described thereinafter and which will form the subject matter of the claims appended hereto.

A BRIEF DESCRIPTION OF THE DRAWINGS

The present invention will be better understood and the objectives of the present invention will become apparent when consideration is given to the following detailed description thereof Such description makes reference to the annexed drawings wherein:

As best shown FIG. 1 shows a side slant view of the device illustrating the components that make up the preferred embodiments of the invention for use in the method of the present invention.

Figure 2:
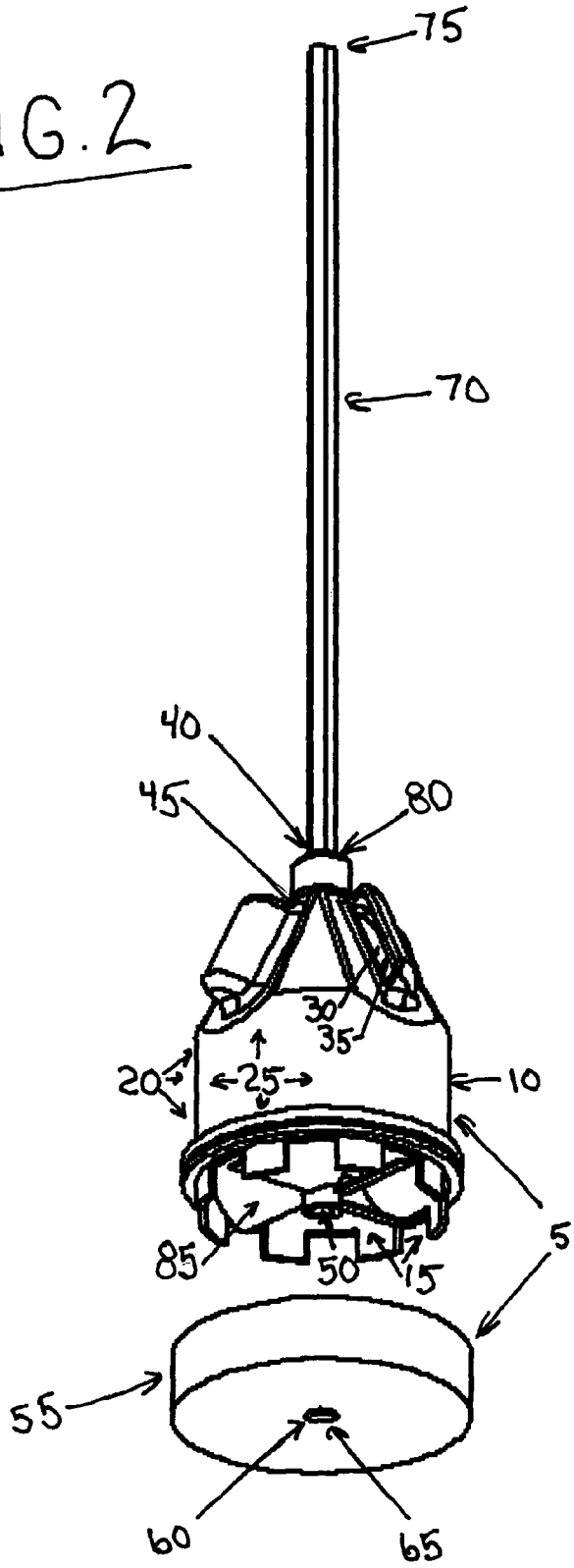

As best shown FIG. 2 shows a bottom slant view of the device illustrated in FIG. 1 illustrating the components that make up the preferred embodiments.

Figure 3:
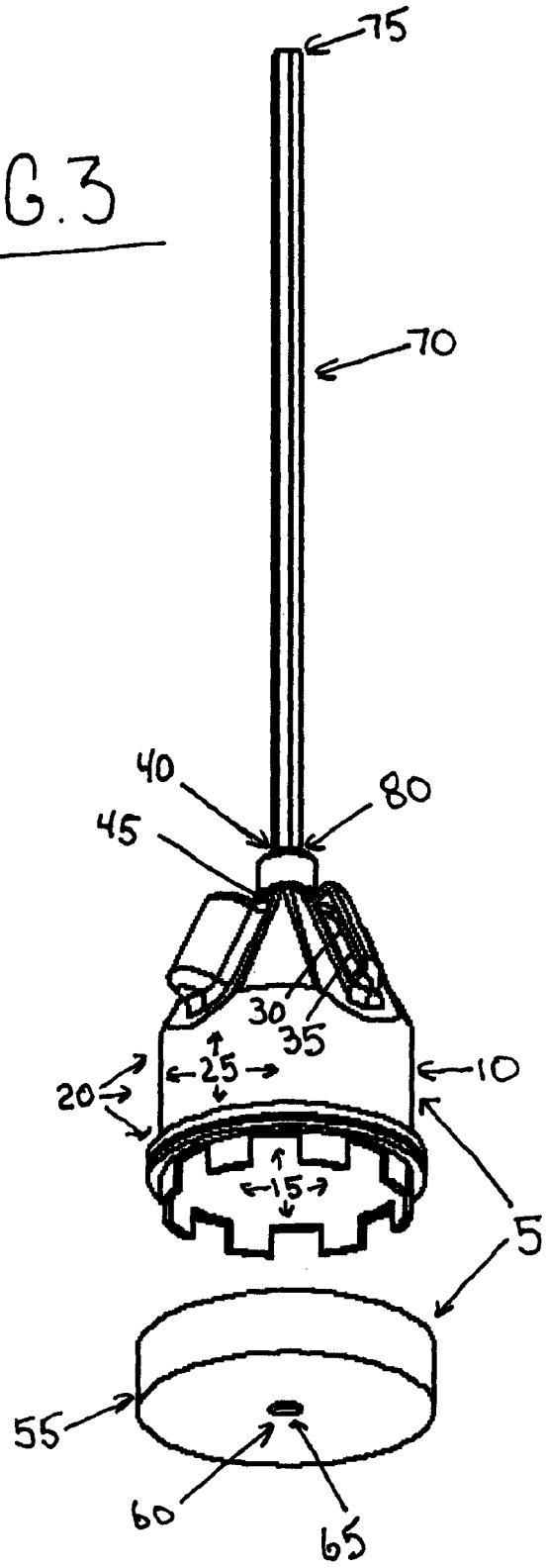

As best shown FIG. 3 shows a bottom slant view of the device illustrated in FIG. 1 without the prop illustrating the components that make up the preferred embodiments.

Figure 4:
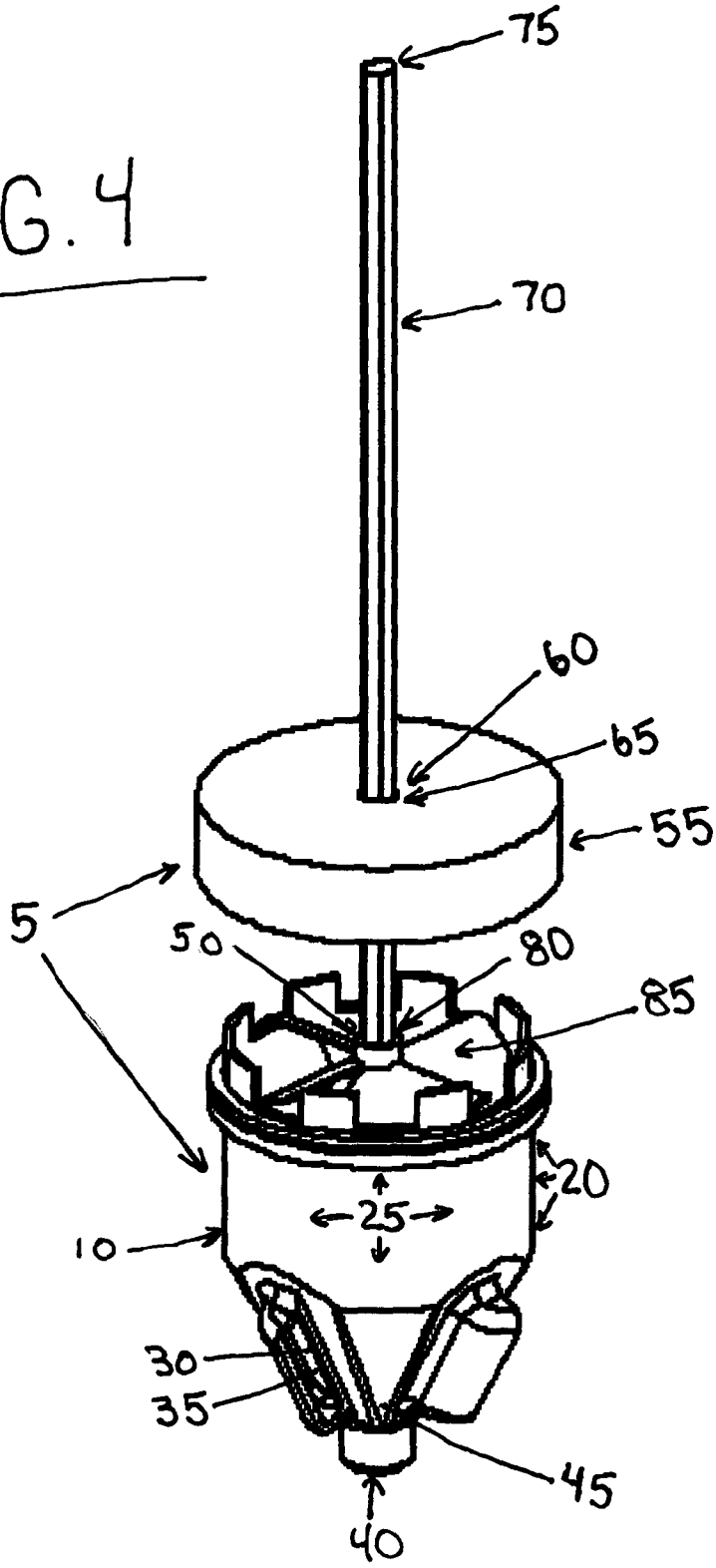

As best shown FIG. 4 shows a bottom slant view of the device illustrated in FIG. 1 invert illustrating the components that make up the preferred embodiments.

Figure 5:
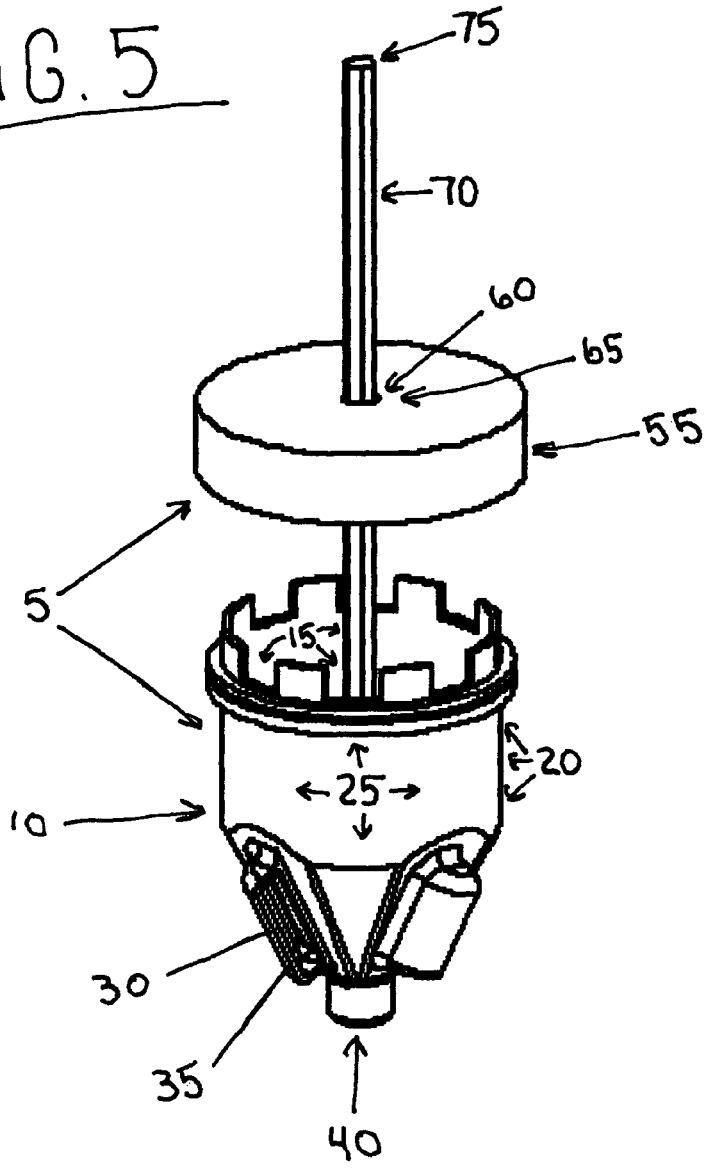

As best shown FIG. 5 shows a bottom slant view of the device illustrated in FIG. 1 invert without the prop illustrating the components that make up the preferred embodiments.

Figure 6:
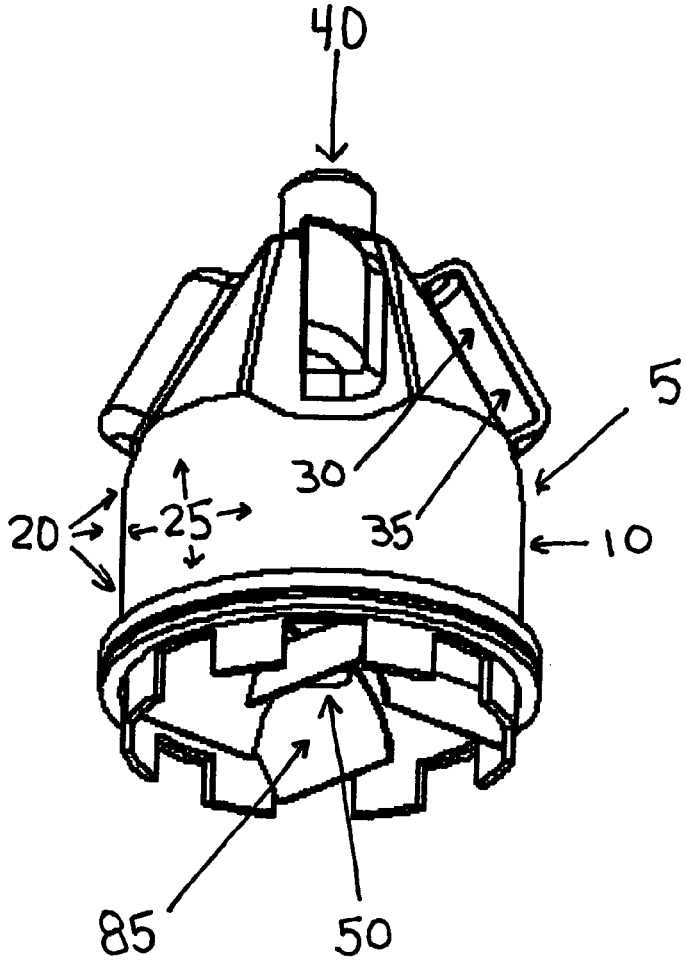

As best shown FIG. 6 shows a bottom slant view of the device illustrated in FIG. 1 with the prop invert illustrating the components that make up the preferred embodiments.

Figure 7:
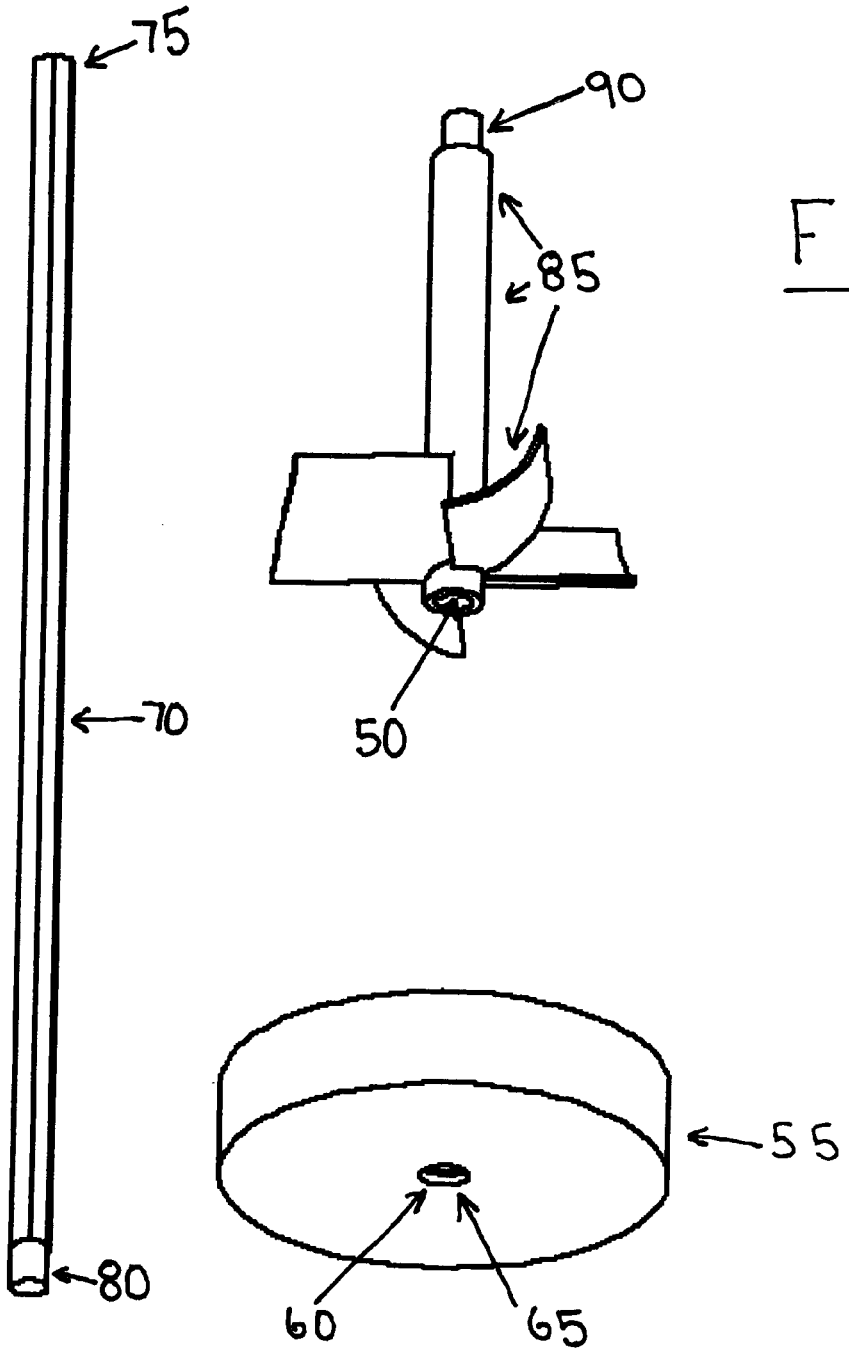

As best shown FIG. 7 shows a top slant view of the shaft, prop and fit cap illustrated in FIG. 1 illustrating the components that make up the preferred embodiments.

Figure 8:
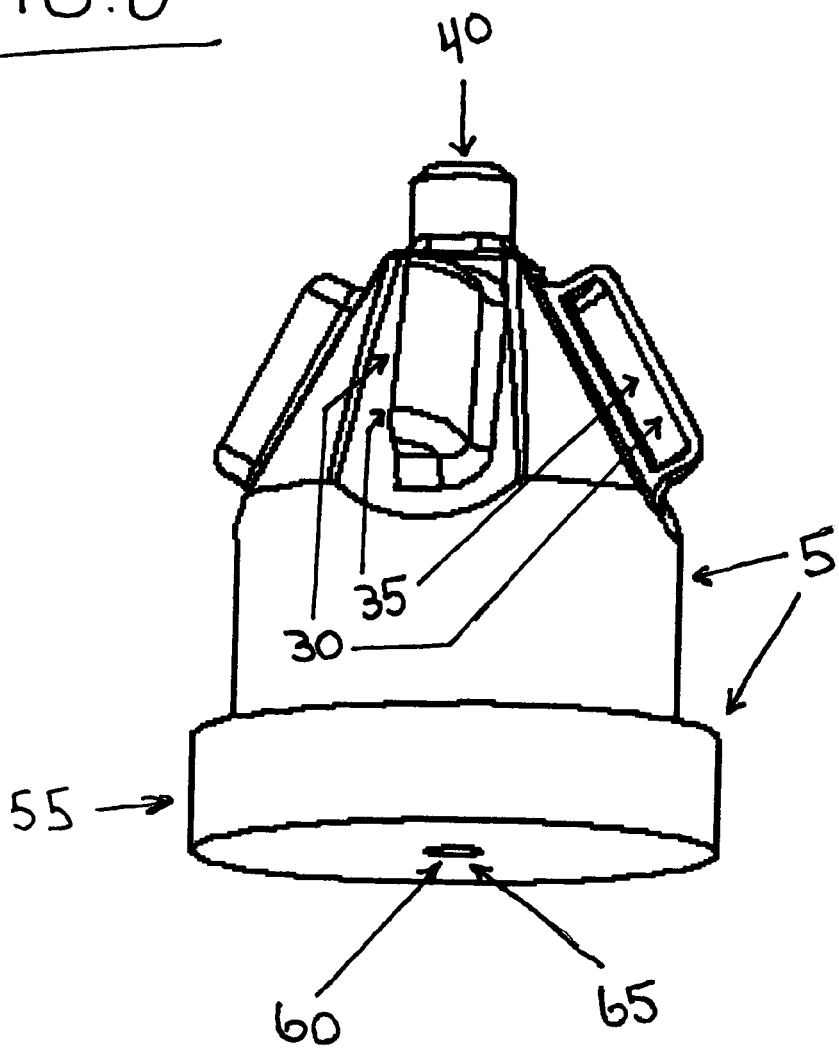

As best shown FIG. 8 shows a side slant view of the device and fit cap illustrated in FIG. 1 secured in the closed position illustrating the components that make up the preferred embodiments.

Figure 9:
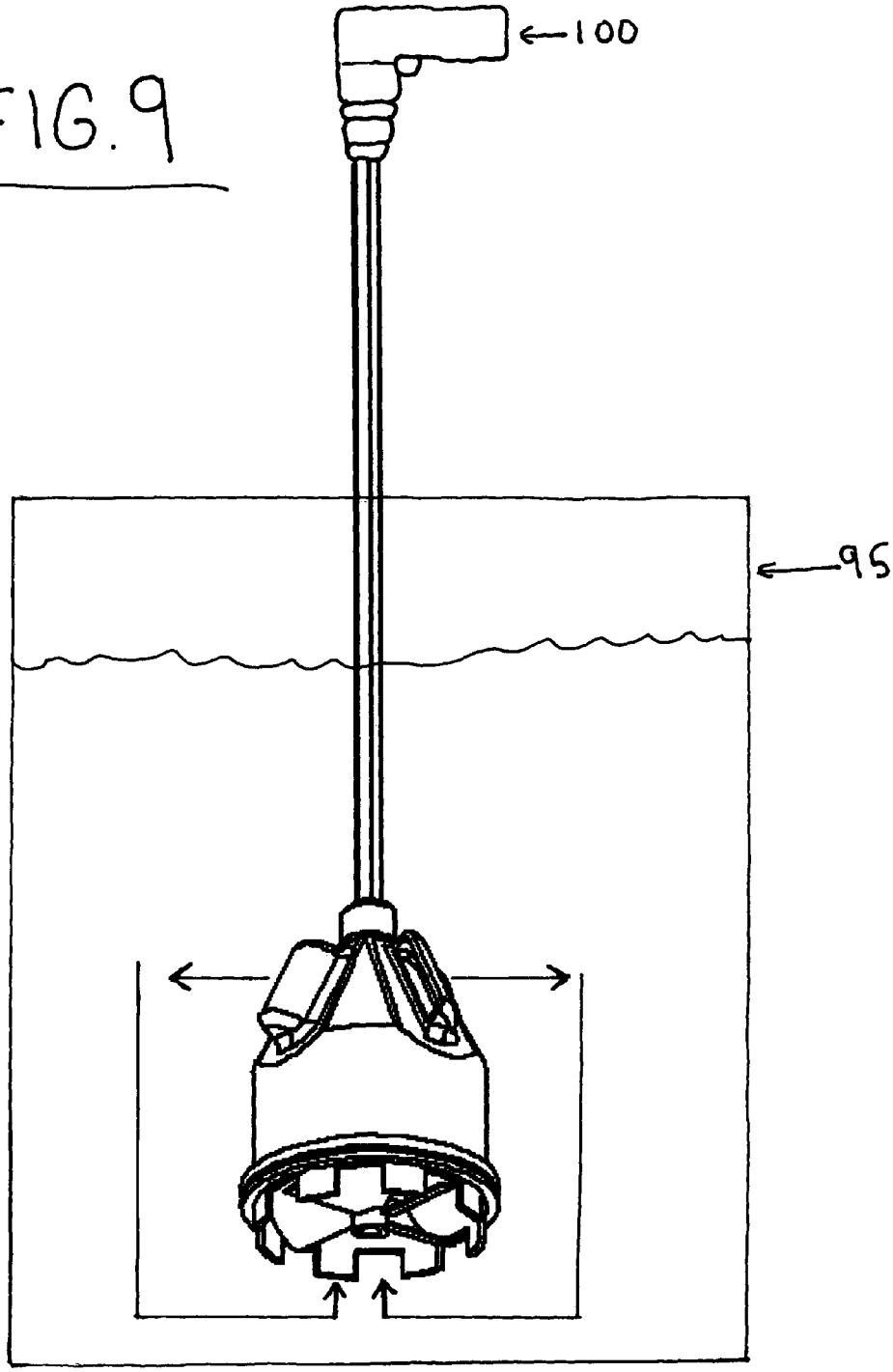

As best shown FIG. 9 illustrates use of the device illustrated in FIG. 2 that make up the preferred embodiments mixing substances and/or fluid in a container, the flow is illustrated by the arrows.

Figure 10:
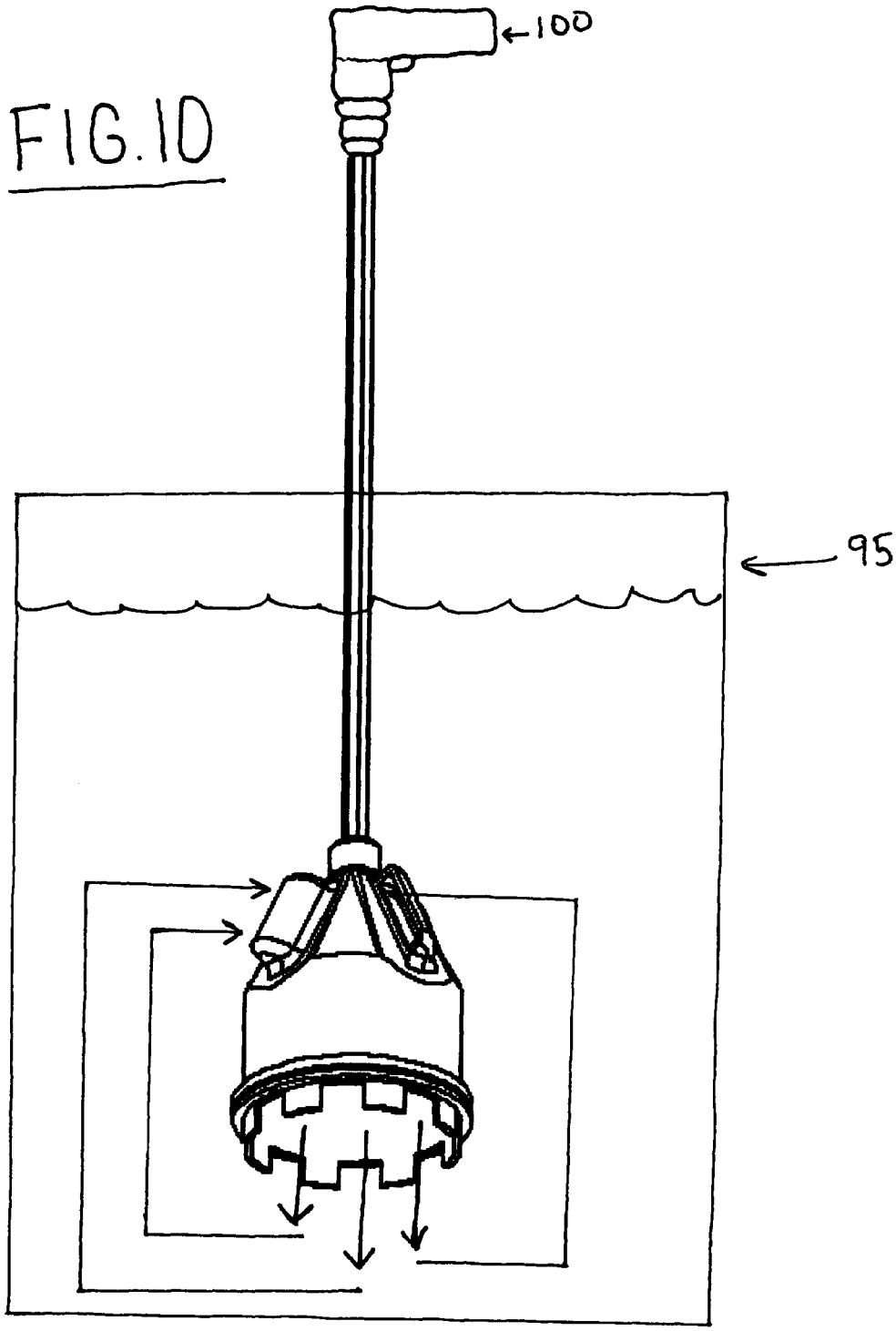

As best shown FIG. 10 illustrates use of the device illustrated in FIG. 3 that make up the preferred embodiments mixing substances and/or fluid in a container, the flow is illustrated by the arrows.

Figure 11:
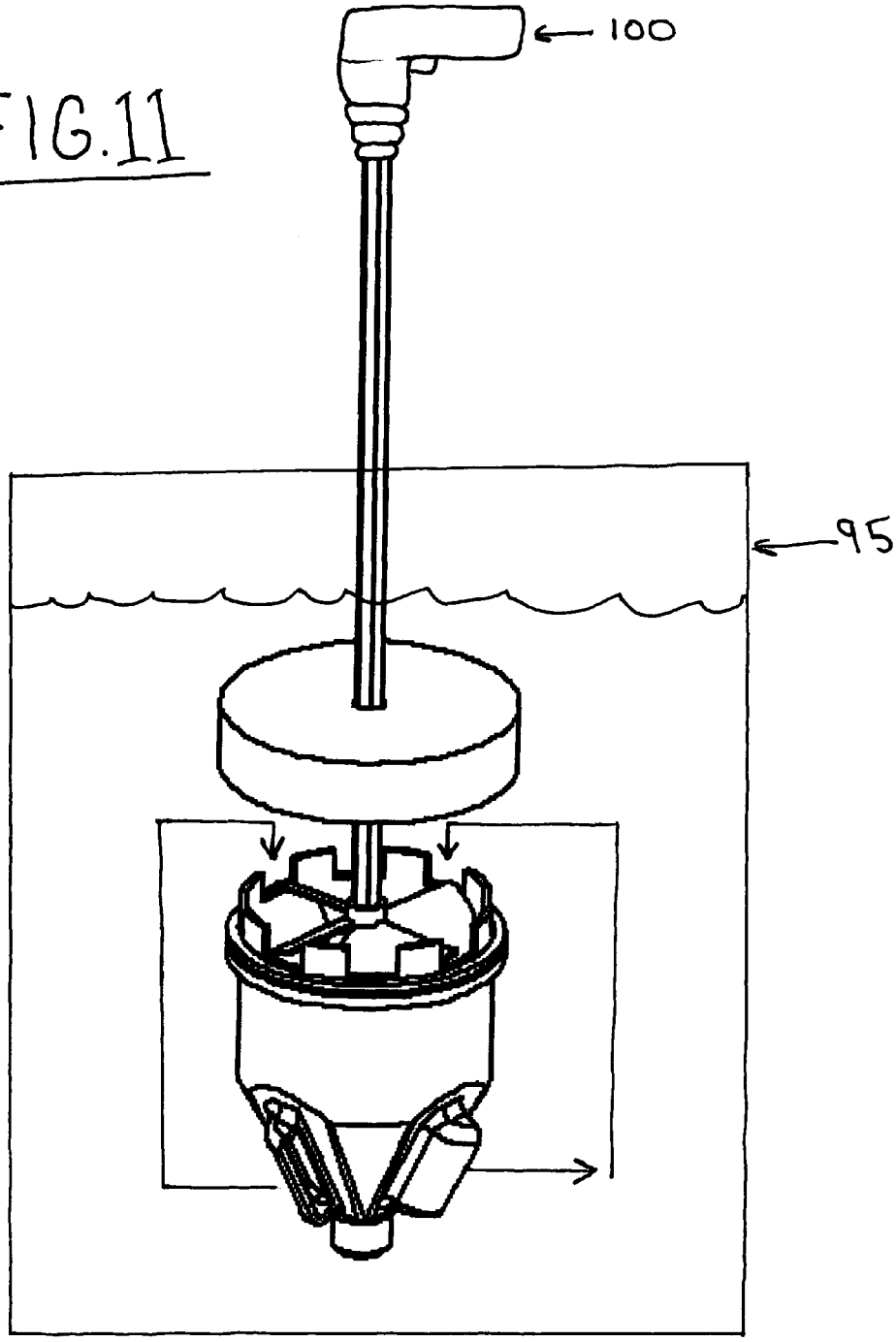

As best shown FIG. 11 illustrates use of the device illustrated in FIG. 4 that make up the preferred embodiments mixing substances and/or fluid in a container, the flow is illustrated by the arrows.

Figure 12:
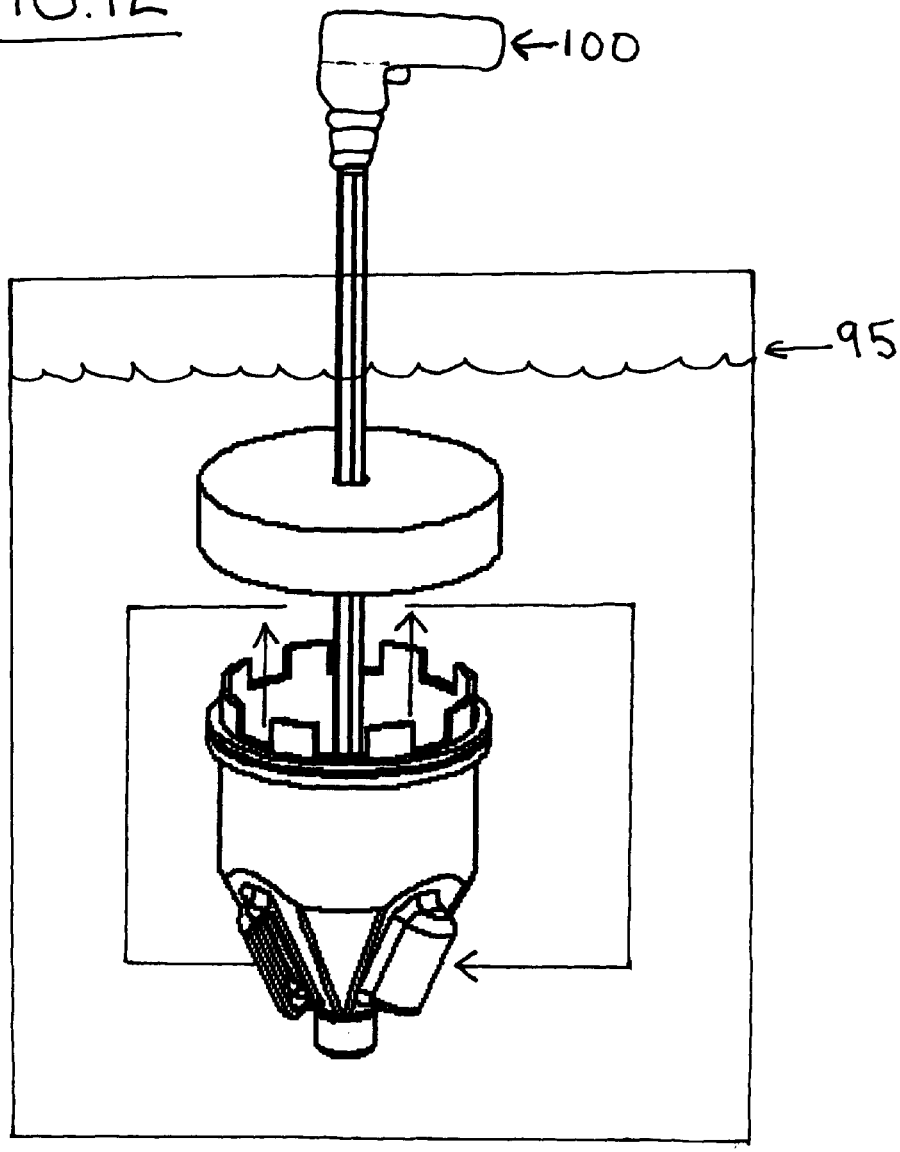

As best shown FIG. 12 illustrates use of the device illustrated in FIG. 5 that make up the preferred embodiments mixing substances and/or fluid in a container, the flow is illustrated by the arrows.

Figure 13:
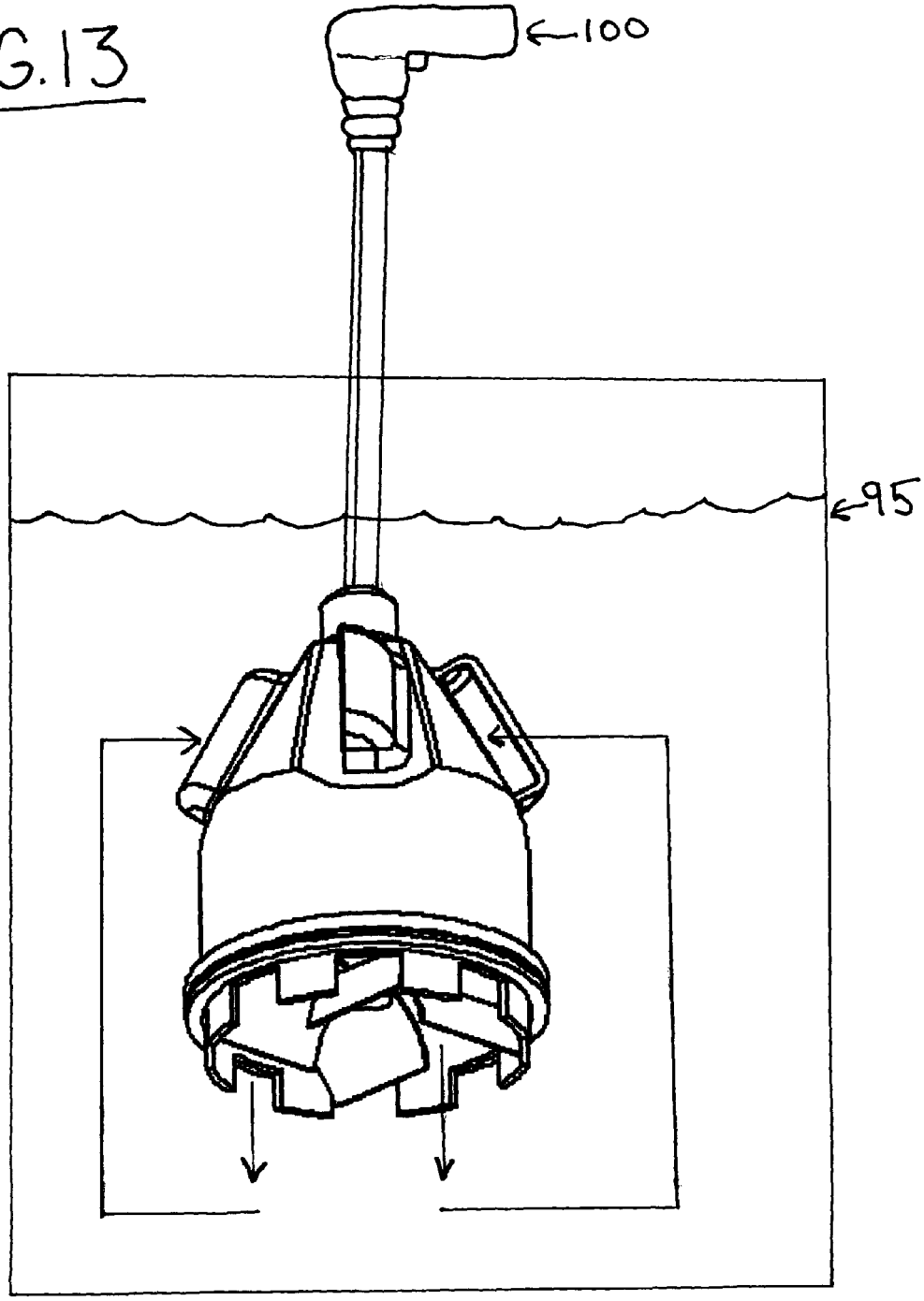

As best shown FIG. 13 illustrates use of the device illustrated in FIG. 6 that make up the preferred embodiments mixing substances and/or fluid in a container, the flow is illustrated by the arrows.

Figure 14:
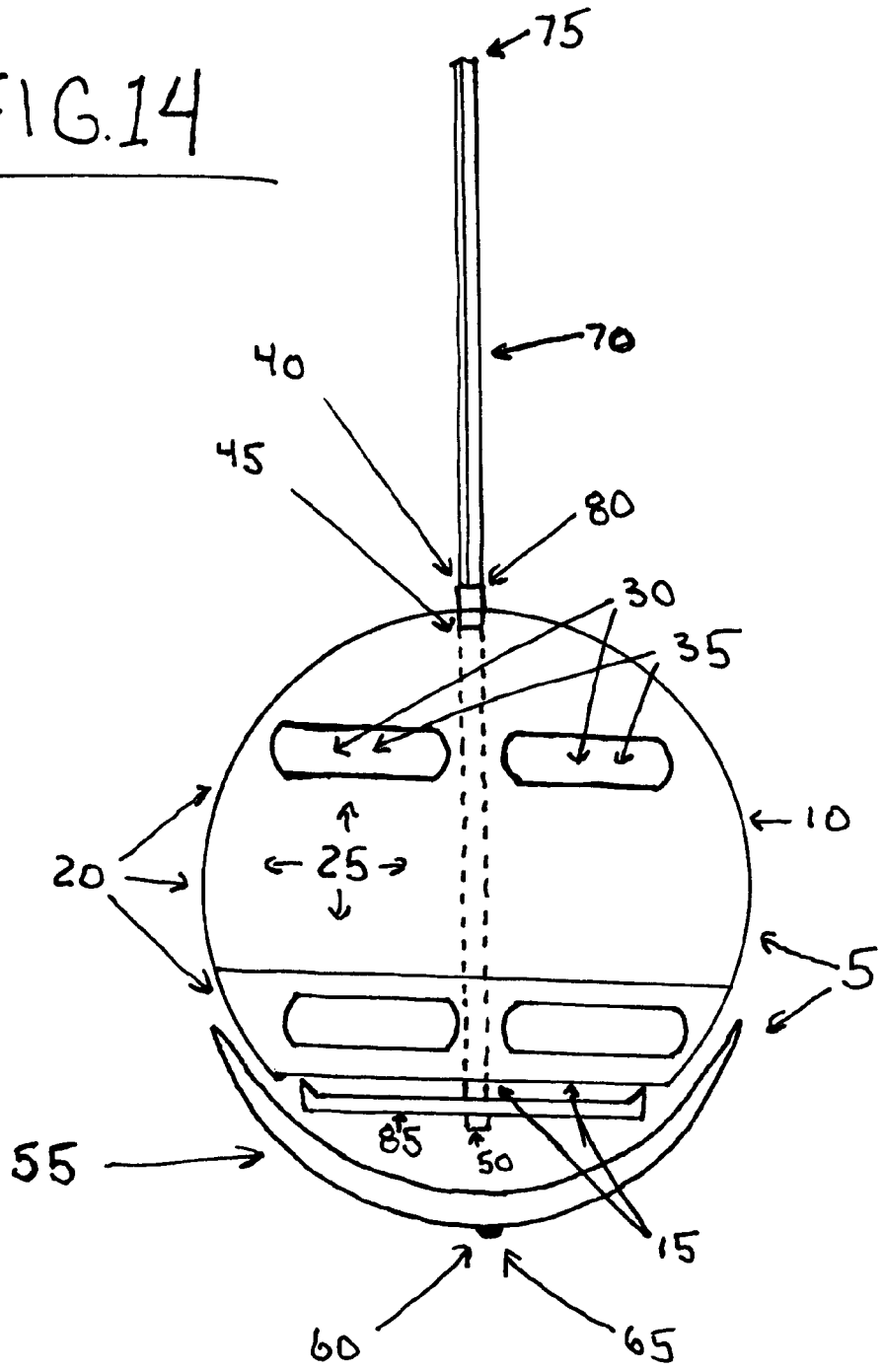

A variation as best shown, FIG. 14 shows a side slant view of a device that works in the same manner as the device in FIG. 2 comprising: a device 5; a body 10; an opening 15; extending sidewalls 20; a cavity 25; passageways 30; doors 35; connector(s) 40,45,50; a fit cap 55; an insert 60; a rubber plug 65; a shaft 70; first end of shaft 75; other end of the shaft 80, and the prop 85.

DETAILED DESCRIPTION OF THE INVENTION

Overview

A device is disclosed for mixing fluid and substances, with a corresponding method of transporting substances, especially coloring substances, and blending it into a container of fluid, and shall also be expounded.

The present invention is a rotary mixing device that is portable and reusable. The cavity holds substances for transportation and delivery into a container of fluid. The device is for blending and mixing substances into fluid, and is also is used for mixing and blending fluid.

A device 5 for holding substances to blend and deliver into a container of fluid comprising of: a body 10 with an opening 15; extending sidewalls 20 that shape a cavity 25; passageways 30 with doors 35; connector(s) 40,45,50; a fit cap 55; a rubber plug 65; a shaft 70; and the prop 85.

More specifically,

A portable multi-use rotary mixing device 5 for rotary discharging a pre-loaded substance into a container of fluid 95 further comprising of: a body 10 having extending sidewalls 20 which forms an open cavity 25; the said body 10 further having operable passageways 30 and doors 35; a shaft 70, at least one end of the said shaft 70 connecting to a drive means 100, the second end of the said shaft 70 is for connecting to said rotary mixing device 5; connector(s), 40,45,50 for combinational linkage; a internal propeller 85 attached to the said shaft 70; and, a fit cap 55 for closing an opening in said body 10; whereby the said rotary mixing device 5 holds said preloaded substances to blend and deliver into a said container of fluid 95.

As best shown FIG. 1 shows a side slant view of the device comprising of: a device 5; a body 10; an opening 15; extending sidewalls 20; a cavity 25; passageways 30; doors 35; connector(s) 40,45,50; a fit cap 55; an insert 60; a rubber plug 65; a shaft 70; first end of shaft 75, other end of the shaft 80.

As best shown FIG. 2 shows a bottom slant view of the device comprising of a device 5; a body 10; an opening 15; extending sidewalls 20; a cavity 25; passageways 30; doors 35; connector(s) 40,45,50; a fit cap 55; an insert 60; a rubber plug 65; a shaft 70; first end of shaft 75; other end of the shaft 80, and the prop 85.

As best shown FIG. 3 shows a bottom slant view of the device without the prop comprising of a device 5; a body 10; an opening 15; extending sidewalls 20; a cavity 25; passageways 30; doors 35; connector(s) 40,45; a fit cap 55; an insert 60; a rubber plug 65; a shaft 70; first end of the shaft 75, other end of shaft 80.

As best shown FIG. 4 shows a bottom slant view of the device invert comprising of: a device 5; a body 10; extending sidewalls 20; a cavity 25; passageways 30; doors 35; connector(s) 40,45,50; a fit cap 55; an insert 60; a rubber plug 65; a shaft 70; first end of shaft 75; other end of the shaft 80, and the prop 85.

As best shown FIG. 5 shows a bottom slant view of the device invert without the prop comprising of a device 5; a body 10; an opening 15; extending sidewalls 20; a cavity 25; passageways 30; doors 35; connector(s) 40; a fit cap 55; an insert 60; a rubber plug 65; a shaft 70, first end of shaft 75.

As best shown FIG. 6 shows a bottom slant view of the device with the prop invert comprising of: a device 5; a body 10; extending sidewalls 20; a cavity 25; passageways 30; doors 35; connector(s) 40,50, and the prop 85.

As best shown FIG. 7 shows a bottom slant view of the shaft, prop and fit cap comprising of: connector(s) 50; a fit cap 55; an insert 60; a rubber plug 65; the shaft 70; first end of shaft 75; other end of the shaft 80; the prop 85, the end of prop shaft 90.

As best shown FIG. 8 shows a side slant view of the device and fit cap secured in the closed position comprising of: a device 5; passageways 30; doors 35; connector(s) 40; a fit cap 55; an insert 60, a rubber plug 65.

A variation as best shown. FIG. 14 shows a side slant view of a device that works in the same manner as the device in FIG. 2 comprising: a device 5; a body 10; an opening 15; extending sidewalls 20; a cavity 25; passageways 30; doors 35; connector(s) 40,45,50; a fit cap 55; an insert 60; a rubber plug 65; a shaft 70; first end of shaft 75; other end of the shaft 80, and the prop 85.

As best shown FIG. 9 illustrates use of the device illustrated in FIG. 2 mixing substances and/or fluid in a container, the flow is illustrated by the arrows. A container 95, and a drill 100.

As best shown FIG. 10 illustrates use of the device illustrated in FIG. 3 mixing substances and/or fluid in a container, the flow is illustrated by the arrows. A container 95, and a drill 100.

As best shown FIG. 11 illustrates use of the device illustrated in FIG. 4 mixing substances and/or fluid in a container, the flow is illustrated by the arrows. A container 95, and a drill 100.

As best shown FIG. 12 illustrates use of the device illustrated in FIG. 5 mixing substances and/or fluid in a container, the flow is illustrated by the arrows. A container 95, and a drill 100.

As best shown FIG. 13 illustrates use of the device illustrated in FIG. 6 mixing substances and/or fluid in a container, the flow is illustrated by the arrows. A container 95, and a drill 100.

Preferred Method of Manufacture

In FIGS. 1 through 8 the device 5, and the fit cap 55, is most preferably manufactured from a plastic polymeric material such as polyethylene and polypropylene which have been shown to have highly advantageous physical characteristics including strength, durability, resistance to denting, and dimensional stability. However, for manufacturing, other compatible and structural material(s) well known to the art worker may be utilized depending on the desired fluid, substance or method of use.

In FIG. 7 the shaft 70 and the prop 85 the preferred material would corrosion resistant stainless steal.

In FIGS. 1 through 8, the device 5 is readily manufactured in different sizes. The cavity 25 of the present invention is not limited to any one volume or dimension. The sidewalls 20 are manufactured relatively smooth to reduce any friction when rotating and to facilitate cleaning of the surfaces after the use of the device 5. The doors 35 are fastened such as by a hinge style and are fabricated to open and close and seal the passageways 30. The passageways 30 and/or doors 35 can be fabricated at any angle or pitch to change or increase the vortex and can have any orientation to achieve a desired flow. The passageways 30 and/or doors 35 are fabricated to manipulate the flow of fluid in any direction to give the best performance per desired fluid. The connector(s) 40,45,50 are for attaching onto the shaft 70, extensions and attachments. The connector(s) 40,45,50 are manufactured to interlock with a shaft 70 also to disconnect and reconnect with the shaft 70 in a male to female orientation and is fabricated to interlock when the shaft 70 is seated in the connector(s) 40,45,50 connected. The shaft 70 is an elongate rigid member having a first end 75 and second end 80. The first end 75 of the shaft 70 is adapted for connection to a rotary means. The second end 80 of the shaft 70 is adapted for connection to the device 5. The exact length and diameter of the shaft 70 depends on the depth of the fluid in the container 95 to be mixed. For instance when the device 5 is used in mixing paint in a standard one-gallon paint can, the shaft 70 can be about 8 to 9 inches long and about 0.25 inches in diameter. The fit cap 55 is manufactured to have a tight securing seal with the present invention. The fit cap 55 has an insert 60 and a rubber plug 65 for seating and sealing the insert 60. The rubber plug 65 is affixed to the inside of the fit cap 55 such as by a hinge style, and it is fabricated to flip open when the shaft 70, extensions and attachments are inserted through for access to the connectors 45 or 50. The end of prop shaft 90 is manufactured to attach with a connector 45 for optionally being removed or attached, and has a connector 50 at the bottom for attaching onto a shaft 70, extensions and attachments. The connector 50 at the bottom of the prop 85 also detaches and attaches the blades of the prop 85 for the option of flipping them over to inverse flow. The device 5 is manufactured also to be used invert as in FIG. 4.

Preferred Methods of Use

This invention is a device and method for transporting and blending substances into a container of fluid, the device mixes and blends fluids and substances. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Generally, the invention comprises of a device and a method of transporting and blending substances into a container containing a fluid to be mixed with the device. As used herein, the term "fluid" generally means liquids, especially those of a viscous nature whether containing dissolved or undissolved solids, slurries, gels and those groupings of solid or semi-solid materials that behave in some respects as fluid, such as granular materials (e.g. flour, sugar, sand, etc). Also used herein, the term "substances" generally means solid, powdery, and/or liquid substances, such as coloring substances, tints. As also used herein, the term "fit cap" generally refers to a means of closure.

With further reference now to the drawings, and in particular to FIGS. 1 through 8, also FIGS. 9 through 13 thereof, the principles of the device 5 is to load, add and isolate desired substances into the device's cavity 25, the cavity 25 holds substances for transportation and delivery into a container 95 of fluid. The fit cap 55 is then secured in its closed position as in FIG. 8. The fit cap 55 seals the container when in its closed position. The device 5 being portable is then transported to a container 95 containing a fluid to be mixed with the device 5. Preferably the user attaches the shaft 70 of the present invention to rotary drive means, as illustrated in FIGS. 9 through 13, the rotary drive means is preferably a drill 100. The means may comprise of an apparatus other than a drill, however, such as hand-driven, pulley or gas motor driven means. These drive means preferably turn the shaft 70 of the device 5 at speed dependent upon the viscosity of the fluid, For example, for low viscosity fluids, the rotational speed may often be as low as about 500 rpm, while for high viscosity fluids, the rotational speed may often be as high as 1,500 rpm or more.

To blend the pre-loaded substances into a container 95 and/or to mix fluids, the user attaches the first end 75 of the shaft 70 preferably to the drill 100, such as by locating the end 75 of the shaft in the chuck of the drill 100. Then the user connects the other end of the shaft 80 to the device 5. Once connected, the user positions the device 5 over the container 95, removes/opens the fit cap 55, tilts the device 5, opens the passageways 30, and lowers the device 5 into the fluid thus, the delivery of pre-loaded substances into the fluid in the container 95. The user locates the device 5 below the top surface of the fluid. A2

Once inserted into the fluid , the drill 100 is turned on, thus effectuating rotational movement of the device 5. While the device 5 is turning, the user may raise and lower it with respect to the top surface of the fluid and the bottom of the container 95, as well as move it from the center to about the outer edges of the container 95, so as to accelerate the mixing of the substances and fluid therein. The device 5 is a rotary mixing device and the rotation of the device 5 and the angle or pitch of the passageways 30 and/or doors 35 as in FIGS. 10 and 12, and/or the rotation of the prop 85 as in FIGS. 9, 11, and 13 moves fluid through the cavity 25 in a rotary discharge and flushes the transported substances circulating them through the container 95, the rotary discharge and flowing direction gains a uniformed affect thus, using the device 5 to blend and mix substances into the fluid. As illustrated in FIGS. 9, 11, and 13 the device 5 mixes and blends the fluid by the rotation of the prop 85 drawing fluid from the opening of the device 5 propelling it through the cavity 25 out the passageways 30 broadcasting it outward from the device 5 in a circulating fashion in the container 95. The mixing effect is also accomplished without the prop 85 as in FIGS. 10 and 12 the rotation of the device 5 and the angle or pitch of the passageways 30 and/or doors 35 diverts fluid into the cavity 25 and out through the opening 15. Therefore the device 5 is used for blending and mixing substances into fluid, and the device 5 is used for mixing and blending fluid. As best shown in FIGS. 9 through 13 the arrows show the depiction of flow and the preferred uses that would mix and blend fluid or would flush the substances out of the cavity 25, and into the container 95 of fluid, to a desired consistency.

Advantageously, the prop 85 can be optionally removed or attached and is used for a greater flow and circulation that is needed in heaver bodied fluids and deeper containers, still in other circumstances it might be required not to use a prop 85. The prop 85 is attachable and detachable such as to accommodate some fluids that require not using prop 85 so as not to sheer, slam or break down the substances in fluid such as metallic or other suspension fluids with solidified ingredients. The prop 85 is attachable to accommodate heavier bodied solidified fluids to help propel fluid through the device 5 to achieve a maximum flow. Still in other instances, the prop 85 can be used invert to inverse the flow. When engaged, the rotation of the prop 85 propels fluid through the opening 15 and cavity 25 and out the passageways 30 as in FIGS. 9, 11 and 13 or when the prop 85 is invert it draws the fluid through the passageways 30 and cavity 30 and out the opening 15 as in FIG. 13. Air is not introduced into the fluid being mixed, so long as the device 5 is properly positioned below the surface of the fluid being mixed.

Also possible, the use of the device 5 described above can also be used invert as in FIGS. 11 and 12. To use invert the fit cap 55 has an insert 60, the user simply inserts the shaft 70 through the insert 60 flipping aside the rubber plug 65 in the fit cap 55 and attaches the shaft 70 into the connector 50 on the bottom of the prop 85 or to the connector 45 at the top of the cavity 35 in the device 5, the user connects the other end of the shaft 75 to a rotary means, preferably a drill 100. The user then lifts the fit cap 55 partway up the shaft 70, opens the passageways 30, lower the device 5 into a container 95 of fluid, and rotates the device 5. The flow of fluid through the cavity 25 is reversible and inverse, to reverse the flow the user simply puts the drill 100 in reverse and reverses the rotation. To inverse the flow, the user simply inverts the prop 85 as in FIG. 6

Advantageously, and as illustrated in FIGS. 9 through 13, the device 5 of the present invention efficiently moves and mixes all of the fluid in the container 95 and effectively blends substances into the fluid.

The device's 5 means of closure is the fit cap 55 and is both securely attached as in FIG. 8 and readily removed when desired. The fit cap 55 is not only to store substances, but also to prevent escape of substances, to prevent the ingress of dust, moisture or other materials into the device 5. Further, to allow opening without special tools and to allow tight resealing. Also the fit cap 55 has an insert 60 and a rubber plug 65 to allow a shaft 70, extensions and attachments access to connector(s) 50 or 45.

After the fluid has been adequately mixed, with the device 5 being reusable, cleaning the device 5 is fast and easy. A user prepares a container filled with a cleaning agent. For example, in the case of latex paints, water is an effective cleaning agent. The user lowers the device 5 into the cleaning agent and turns on the drill 100. The rapid movement of the cleaning agent through the device 5 causes any remaining fluid thereon to be cleansed from the device 5. Once the device 5 is clean, which normally only takes seconds, the device 5 can be left to air dry.

Use of the device 5 described above in the method of the present invention will now be described with reference to FIGS. 1 through 13.

A method of transporting and blending substances into a container 95 of fluid comprising; using a portable mixing device for transporting substances into a container 95 of fluid and further includes using the device 5 to blend and mix substances into fluid. The device 5 holds the substances to blend and deliver into a container 95 of fluid and method uses a rotary mixing device.

Preferably the user obtains desired substances. The desired substances are loaded, added and isolated into the cavity 25 of the device 5 and the fit cap 55 is secured in its closed position as in FIG. 8. The user then transports the device 5 and substances to a container 95 of fluid as in FIGS. 9 and 13. The user connects the device 5 to a rotary means, preferably a drill 100 by means of a shaft 70. Once connected the user removes/opens the fit cap 55 opens the passageways 30 and lowers the device 5 into the fluid of the container 95, thus delivering the substances. The user turns on the drill 100 thus, effectuating rotational movement of the device 5. The rotation of the device 5 moves fluid into and through the cavity 25 flushing any remaining substances, blending the fluid and substances in the container 95, to a desired consistency thus, using the device 5 to blend and mix substances into the fluid. The method of transporting and blending substances into a container of fluid 95 can be applied to paints, stains, epoxy and other fluids.

Therefore, the forgoing is considered as illustrative only of the principles of the present invention. Further, since numerous modifications and changes will readily occur to those skilled in the art, it is not desired to limit the present invention to the exact construction and operation shown and described, and accordingly, all suitable modifications and equivalents may be resorted to falling within the scope of the invention.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Variations

As best shown FIG. 14 shows a side slant view of a device that works in the same manner as the device in FIG. 2 comprising: a device 5; a body 10; an opening 15; extending sidewalls 20; a cavity 25; passageways 30; doors 35; connector(s) 40,45,50; a fit cap 55; an insert 60; a rubber plug 65; a shaft 70; first end of shaft 75; other end of the shaft 80, and the prop 85.

What is claimed is:

1. A portable multi-use rotary mixing device for rotary discharging a pre-loaded substance into a container of fluid, the portable multi-use rotary mixing device, which comprises:

a body having extending sidewalls which forms an open cavity; the said body further having operable passageways and doors; a shaft, one end of the said shaft connecting to a drive means, the second end of the said shaft connecting to said body;

at least one connector, for combinational linkage; an internal propeller attached to the said shaft; and, a fit cap for closing an opening in said body;

whereby the said rotary mixing device holds said preloaded substances to blend and deliver into a said container of fluid.

2. The said drive means of claim 1 wherein the rotary mixing device is a drill.

3. The said doors of claim 1 wherein the rotary mixing device are linked to the said passageways.

* * * * *